US008404957B2

(12) United States Patent
Richards

(10) Patent No.: US 8,404,957 B2
(45) Date of Patent: Mar. 26, 2013

(54) DRUM TUNING APPARATUS

(76) Inventor: Steven S. Richards, Snohomish, WA (US)

( * ) Notice: Subject to any disclaimer, the term of this patent is extended or adjusted under 35 U.S.C. 154(b) by 22 days.

(21) Appl. No.: 13/286,042

(22) Filed: Oct. 31, 2011

(65) Prior Publication Data

US 2012/0279376 A1 Nov. 8, 2012

Related U.S. Application Data

(60) Provisional application No. 61/409,306, filed on Nov. 2, 2010.

(51) Int. Cl.
*G10D 13/02* (2006.01)

(52) U.S. Cl. ..... 84/413; 84/411 R

(58) Field of Classification Search ..... 84/413
See application file for complete search history.

(56) References Cited

U.S. PATENT DOCUMENTS

| | | | | |
|---|---|---|---|---|
| 2,051,671 | A | 8/1936 | Au-Miller | |
| 2,061,244 | A | 11/1936 | Au-Miller | |
| 2,433,200 | A | 12/1947 | Cordes | |
| 3,346,139 | A | 10/1967 | Armstrong | |
| 4,154,136 | A | 5/1979 | McIntyre | |
| 4,211,144 | A | 7/1980 | May | |
| 4,228,721 | A | 10/1980 | Hancox | |
| 4,506,586 | A * | 3/1985 | Brewer | 84/413 |
| 5,392,681 | A | 2/1995 | Hall | |
| 6,043,419 | A | 3/2000 | Arbiter | |
| 7,501,567 | B1 * | 3/2009 | Spinazzola | 84/411 R |
| 7,642,441 | B2 * | 1/2010 | Cohen | 84/411 R |
| 7,777,112 | B2 | 8/2010 | O'Connor | |
| 2008/0173157 | A1 | 7/2008 | Liao | |
| 2009/0064844 | A1 | 3/2009 | O'Connor | |

FOREIGN PATENT DOCUMENTS

| | | |
|---|---|---|
| JP | 2008090058 | 4/2008 |

* cited by examiner

*Primary Examiner* — Christopher Uhlir
(74) *Attorney, Agent, or Firm* — Æ ON Law; Adam L. K. Philipp

(57) ABSTRACT

An acoustic-drum tuning assembly includes a single adjustment feature to vary the drumhead tension uniformly around the drumhead's periphery. The tuning mechanism includes multiple rings located between the end of the drum shell (or support ring) and the "underside" of the drumhead, which is otherwise restrained with respect to the drum shell by a hoop or rim fixed in place by threaded tension rods and lugs or other hoop-fixing mechanism. The single adjustment feature varies the circumference of a wedging ring, which generates an axial force "expanding" or "retracting" the tuning assembly along the central axis of the drum. When the tuning assembly axially "expands", it pushes increasingly "upward" against the drumhead, variably increasing its tension and the musical pitch of the drum. When the tuning assembly axially "retracts", it decreases the "upward" push, variably decreasing the drumhead tension and lowering the musical pitch of the drum.

17 Claims, 15 Drawing Sheets

DRUM TUNING APPARATUS

CROSS REFERENCE TO RELATED APPLICATIONS

This application claims the benefit of priority to U.S. Provisional Application No. 61/409,306, filed Nov. 2, 2010, titled "DRUM-TUNING APPARATUS," naming inventor Steven S. Richards. The above-cited application is incorporated herein by reference in its entirety, for all purposes.

FIELD

The present disclosure relates to acoustic musical instruments, and more particularly, to a drumhead tuning apparatus installed on a conventional musical drum.

BACKGROUND

Snare drums, toms, bass drums, timbales, shell-less drums, and other like acoustic drums typically include a drum shell (or other rigid support ring) with a drumhead stretched over one or both open ends of the shell, the drumhead(s) bearing against a shaped edge, or "bearing edge", on the end(s) of the shell. The tension in such drumheads is a key factor affecting the musical pitch and timbre of such acoustic drums, whether used individually or as part of a drum set. For acoustic drums having both a "top" ("batter") head and a "bottom" ("resonator") head, the drum's timbre is also affected by the relationship between the overall tension of the resonator head and the overall tension of the batter head. Consequently, most acoustic drums include a mechanism to adjust tension of each drumhead so that a desired musical pitch and/or timbre may be achieved.

Additionally, desirable drum timbres are often facilitated when the tension in a drumhead is applied uniformly around its periphery. However, geometric imperfections inevitably exist or arise in the drumhead, hoop, and/or bearing edge of the drum shell. Consequently, multiple adjustment points are typically required to vary the drumhead tension while maintaining uniform tension in the drumhead around its periphery.

To that end, typical acoustic drums engage the outer periphery of the drumhead (the rigid part of the drumhead that is larger in diameter than the shell) with a rigid hoop configured with multiple, evenly-spaced attachment features around it outer periphery. Special threaded fasteners, or "tension rods", are assembled through the attachment features of the hoop and threaded into multiple, evenly-spaced lugs rigidly attached to the outer periphery of the shell. By applying a tightening torque to all of the tension rods, the hoop variably forces the outer periphery of the drumhead in an axial direction toward the opposite end of the shell. Since this force is being reacted by the interaction of the inner part of the drumhead with the bearing edge of the shell, this all-tension-rod tightening torque results in increased tension in the drumhead, which increases its fundamental frequency, thereby raising the musical pitch of the drum. Conversely, if a loosening torque is applied to all of the tension rods, the fundamental frequency of the drumhead is decreased, thereby lowering the musical pitch of the drum.

Multiple-tension-rod tuning mechanisms employed on typical acoustic drums are useful for achieving uniform drumhead tensions. However, multiple-tension-rod tuning mechanisms also require significant effort and skill to change the overall tension of a drumhead without losing peripheral tension uniformity. The effort and skill required increases for drums having heads on both ends of the shell, and it increases further for drums used in a drum set, where the musical pitch of each drum must be adjusted with respect to that of all other drums in the drum set. Further complications can also arise because the tension rods on the resonator head ends of the drums are frequently difficult to access while the drum is set up in the drum set.

Learning and applying the skills required to properly tune a drum (i.e., achieve the desired musical pitch and timbre of the drum) can be difficult for some percussionists to master. Often, percussionists will tune a drum until its musical pitch and timbre are "good enough", but they may only rarely achieve the truly desired pitch and optimum timbre due to the additional effort and skill required.

DESCRIPTION

Figure 1:
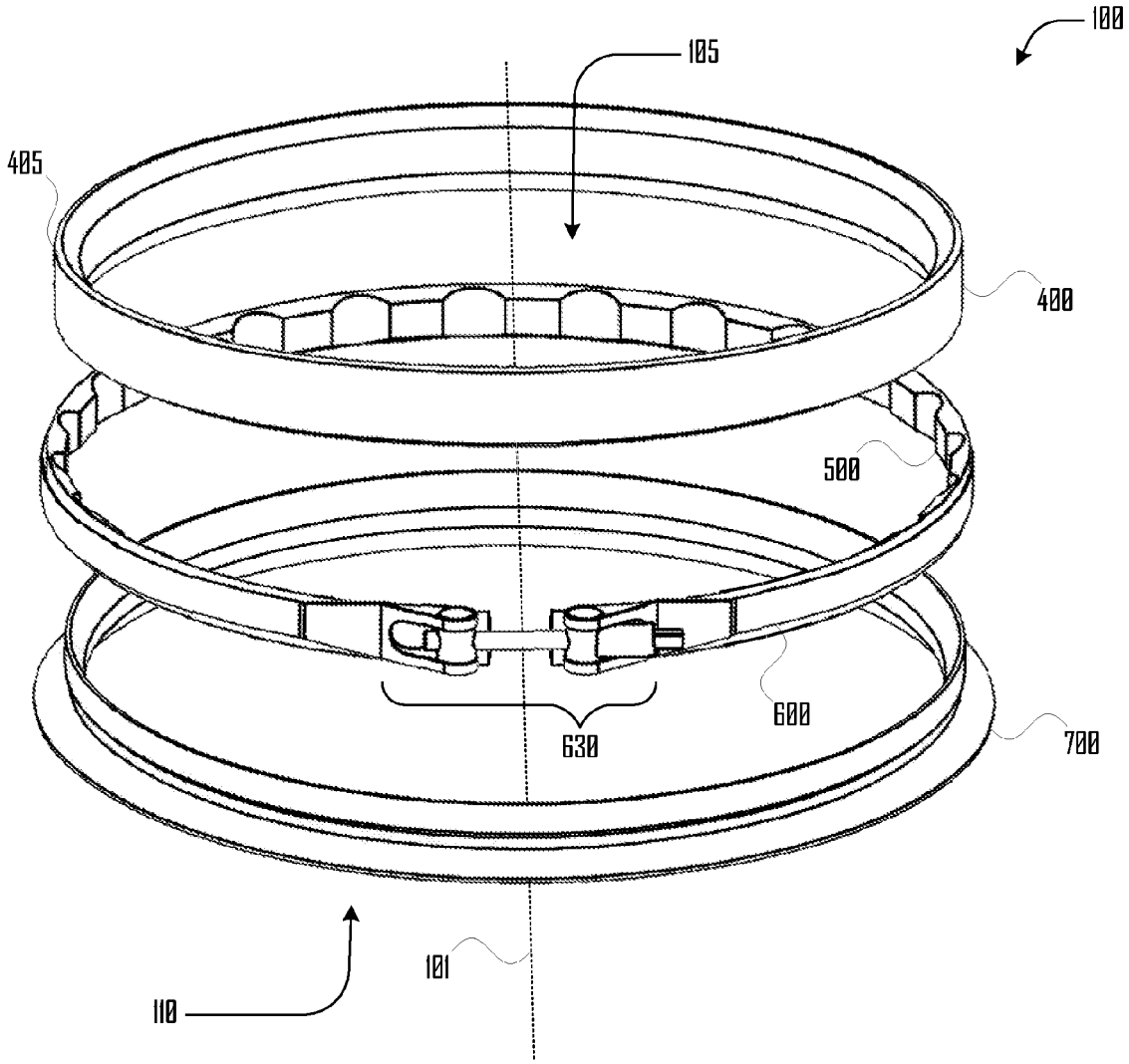
FIG. 1 is an exploded view of components of a drum tuning assembly in accordance with one embodiment.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

In various embodiments, an acoustic-drum tuning assembly includes a single adjustment feature to vary the drumhead tension uniformly around the drumhead's periphery. The tuning mechanism includes multiple rings located between the end of the drum shell and the "underside" of the drumhead. The drumhead is otherwise restrained with respect to the drum shell by a hoop or rim fixed in place by multiple conventional tension rods and tuning lugs or other hoop-fixing mechanism. The single adjustment feature varies the circumference of a wedging ring, which generates an axial force causing the tuning assembly to "expand" or "retract" along the central axis of the drum. When the tuning assembly axially "expands", it pushes increasingly "upward" against the drumhead, increasing its tension and the musical pitch of the drum. Conversely, when the tuning assembly axially "retracts", it decreases the "upward" push, thereby decreasing the drumhead tension and lowering the musical pitch of the drum.

FIG. 1 is an exploded view of components of a drum tuning assembly 100 in accordance with one embodiment. Drum tuning assembly 100 includes pilot ring 700, circumferentially-variable wedging ring 500, adjustable circumferential-tensioning assembly 600, and circumferentially-fixed bearing ring 400, all encircling a central assembly axis 101. Drum tuning assembly 100 also exhibits an "upper" mouth (or opening) 105 and a "lower" mouth 110. Upper mouth 105 is bounded by an annular drumhead-contact surface 405. As discussed further below, in operation, a drumhead (not shown in FIG. 1) is stretched across upper mouth 105 and drumhead-contact surface 405, while lower mouth 110 is fixed in relation to a shell or other supporting ring (not shown in FIG. 1).

Drum tuning assembly 100 also includes a single adjustment feature 630, which when actuated in the tightening direction, "expands" the tuning assembly 100 along central assembly axis 101, thereby pushing "upward" against the drumhead (not shown in FIG. 1), increasing its tension and raising the musical pitch of the drum. Conversely, when the single adjustment feature 630 is actuated in the loosening direction, the tuning mechanism "retracts" along central assembly axis 101, decreasing the drumhead tension and lowering the musical pitch of the drum. While tightening or loosening, drum tuning assembly 100 applies uniform force around the drumhead periphery to maintain uniform tension on the drumhead (not shown), assuming the drumhead was initially adjusted to a state of uniform peripheral tension.

Figure 2A:
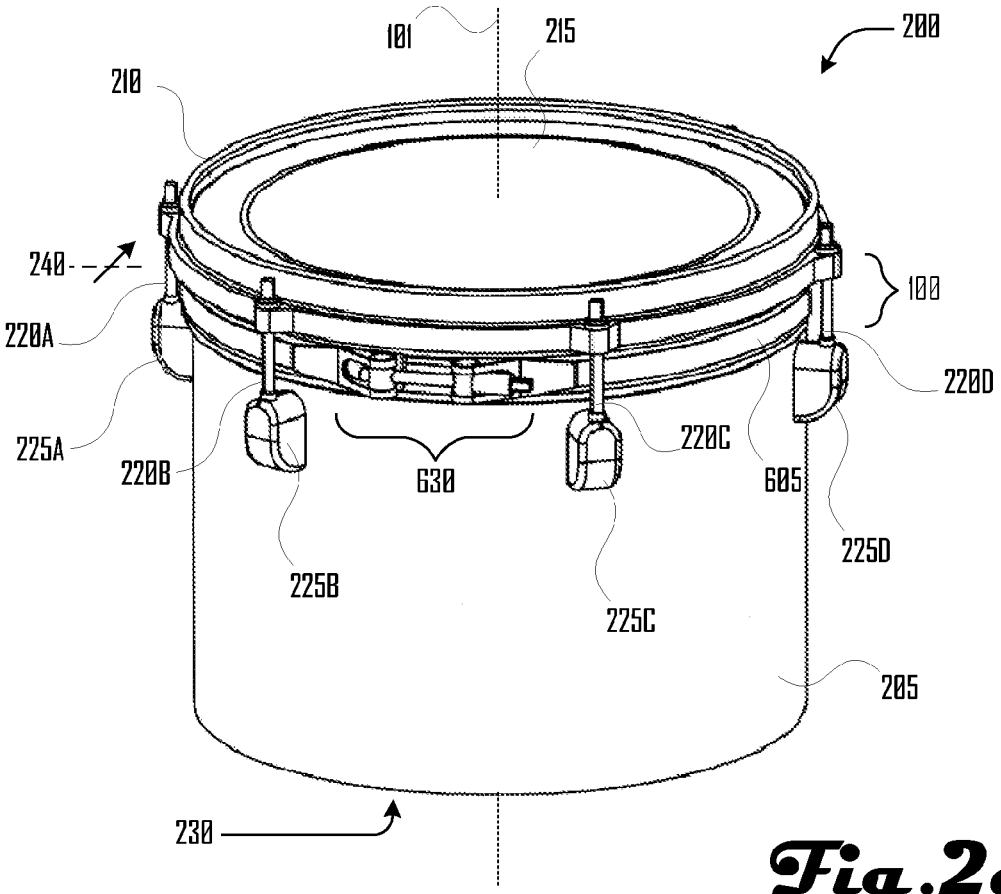
FIGS. 2*a-b* respectively show front and rear views of an acoustic drum including a drum tuning assembly, in accordance with one embodiment.
Figure 2B:
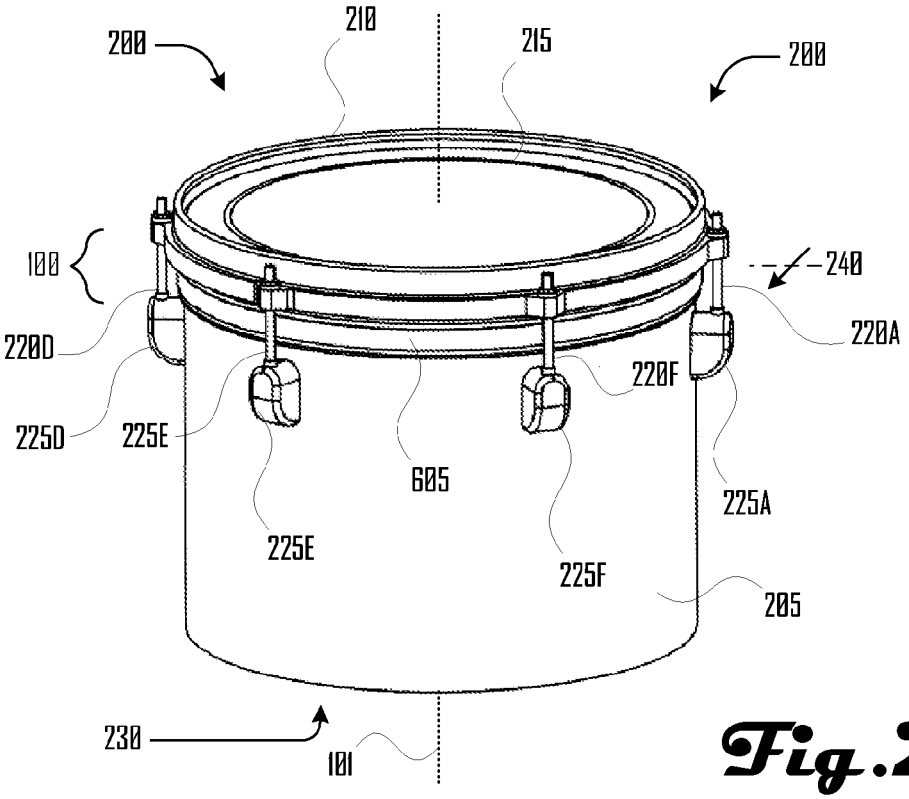

FIGS. 2*a-b* respectively show front and rear views of an acoustic drum 200, such as a snare drum, tom, bass drum, timbale, shell-less drum, or other like acoustic drum, in accordance with one embodiment. Portions of drum tuning assembly 100 are visible in FIGS. 2*a-b*, including tension strap 605 and single adjustment feature 630 (see FIG. 6, discussed below). Several components of drum tuning assembly 100 that are not visible in FIGS. 2*a-b* are illustrated in FIGS. 3-9, discussed below.

In the illustrated embodiment, single adjustment feature 630, tension strap 600, and other (hidden) components of drum tuning assembly 100 operate in conjunction with conventional tuning lugs 225A-F, tension rods 220A-F, and hoop 210 (also referred to as a "rim") to vary the tension of the drumhead 215, thereby changing the musical pitch of the drum (also referred to as "tuning" the drum). In the illustrated embodiment, hoop 210 restrains the periphery of drumhead 215, such that tension rods 220A-F may be used to initially equalize the tension in the drumhead 215 around its periphery while the drum tuning apparatus is in a minimum-tension position (see FIG. 8*a*, discussed below). Once drumhead 215 is in a state of uniform peripheral tension, single adjustment feature 630 may be actuated to uniformly adjust drumhead tension to achieve the desired musical pitch of the drum.

More specifically, and as discussed further below, when single adjustment feature 630 is actuated in the tightening direction, drumhead 215 is increasingly urged "upwards" along central assembly axis 101, away from support ring 205, increasing its tension and raising the musical pitch of the drum. Conversely, when single adjustment feature 630 is actuated in the loosening direction, drumhead 215 is decreasingly urged "upwards" along central assembly axis 101, decreasing its tension and lowering the musical pitch of the drum.

Should non-uniform drumhead tension develop, such as due to non-uniform permanent stretching of drumhead 215 with use, the conventional tension rods 220A-F may be adjusted as necessary to restore uniform tension on drumhead 215. Subsequently, single adjustment feature 630 may be again tightened (or loosened) as necessary to uniformly restore the drum to the desired musical pitch.

In the illustrated embodiment, single adjustment feature 630 is located between hoop 210 and support ring 205, on the drum's external periphery to provide convenient access to the single adjustment feature 630. In some embodiments, to actuate single adjustment feature 630, a percussionist may engage a drum key or equivalent drive tool and apply torque as desired to vary the drumhead tension.

In some embodiments, for dual-headed drums, a second tuning mechanism (not shown) can be used on the "bottom" end of the drum, with the single adjustment features of each mechanism oriented on the drum for ease of accessibility by the percussionist. In some embodiments, for drums set up in a drum set, single adjustment feature 630 may be oriented so as to be accessible to the percussionist while the percussionist is in the drum-set playing position.

Figure 3:
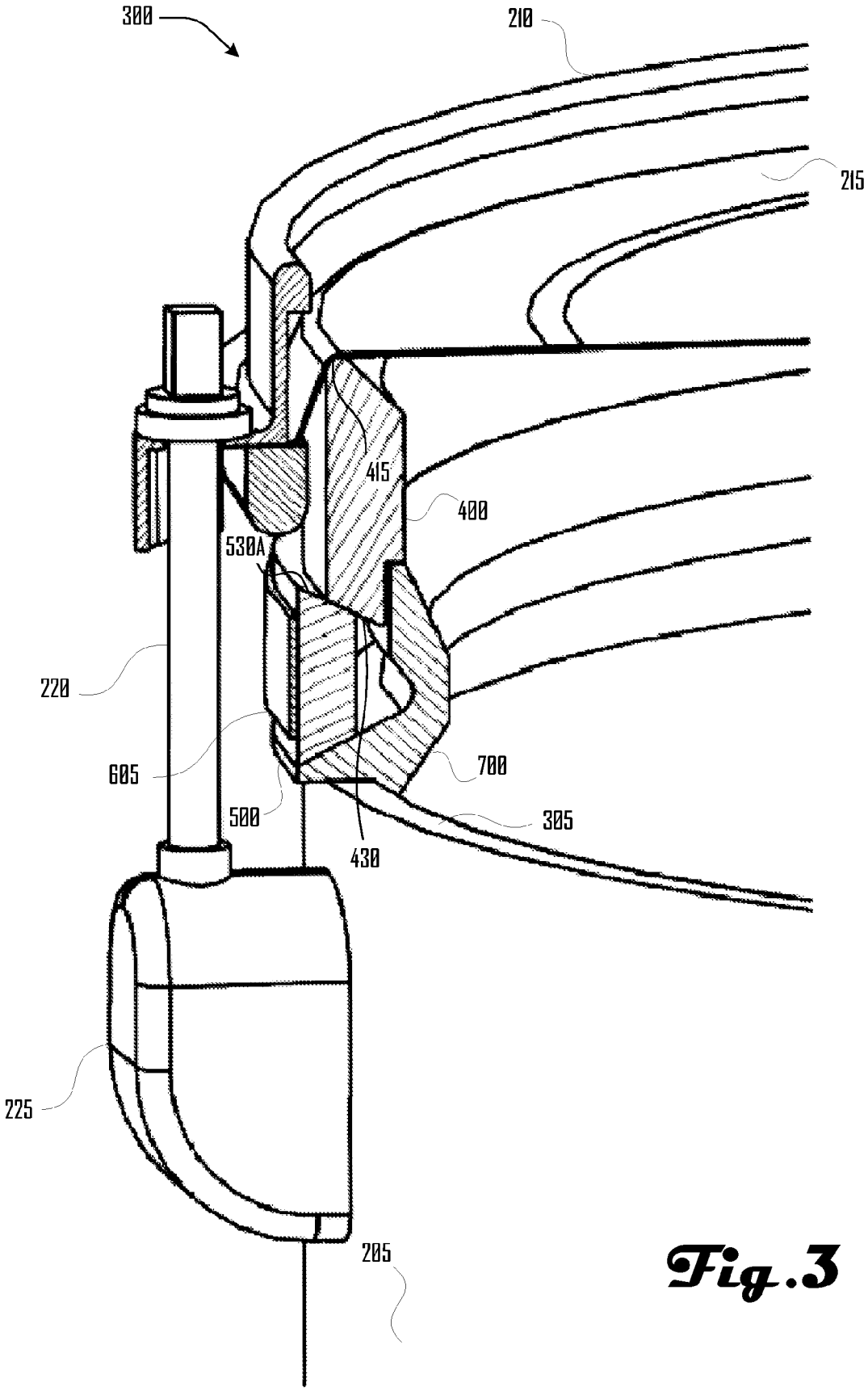
FIG. 3 is a cross-section view of the drum tuning assembly, in accordance with one embodiment.

FIG. 3 shows a cross-section view 300 (taken at the plane indicated by broken line 240 in FIG. 2) of drum 200, illustrating several otherwise hidden components of drum tuning assembly 100 in accordance with one embodiment. As illustrated, tuning assembly 100 interacts with a conventional drumhead 215, hoop 210, lugs 225, tension rods 220, and shell 205 to vary the drumhead tension in drumhead 215.

In the illustrated embodiment, drum tuning assembly 100 incorporates a wedge element (circumferentially-variable wedging ring 500, see FIG. 5, discussed below) surrounded by tension strap 605 (part of adjustable circumferential-tensioning assembly 600, see FIG. 6, discussed below) and axially positioned between pilot ring 700 (see FIG. 7, discussed below) and circumferentially-fixed bearing ring 400 (see FIG. 4, discussed below).

Figure 4A:
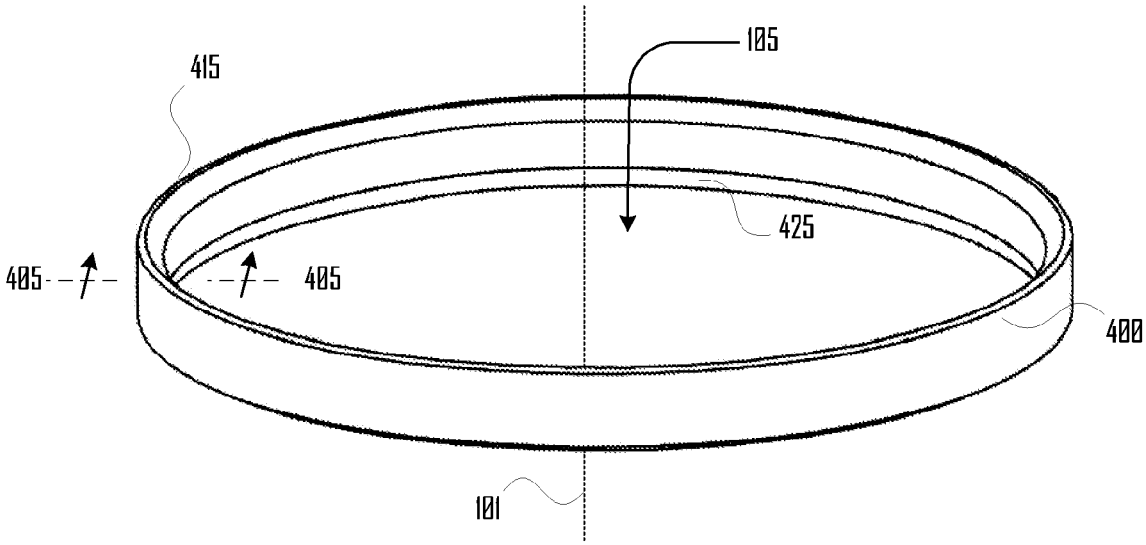
FIG. 4*a-b* are perspective and cross-section views of a circumferentially-fixed bearing ring in accordance with one embodiment.
Figure 4B:
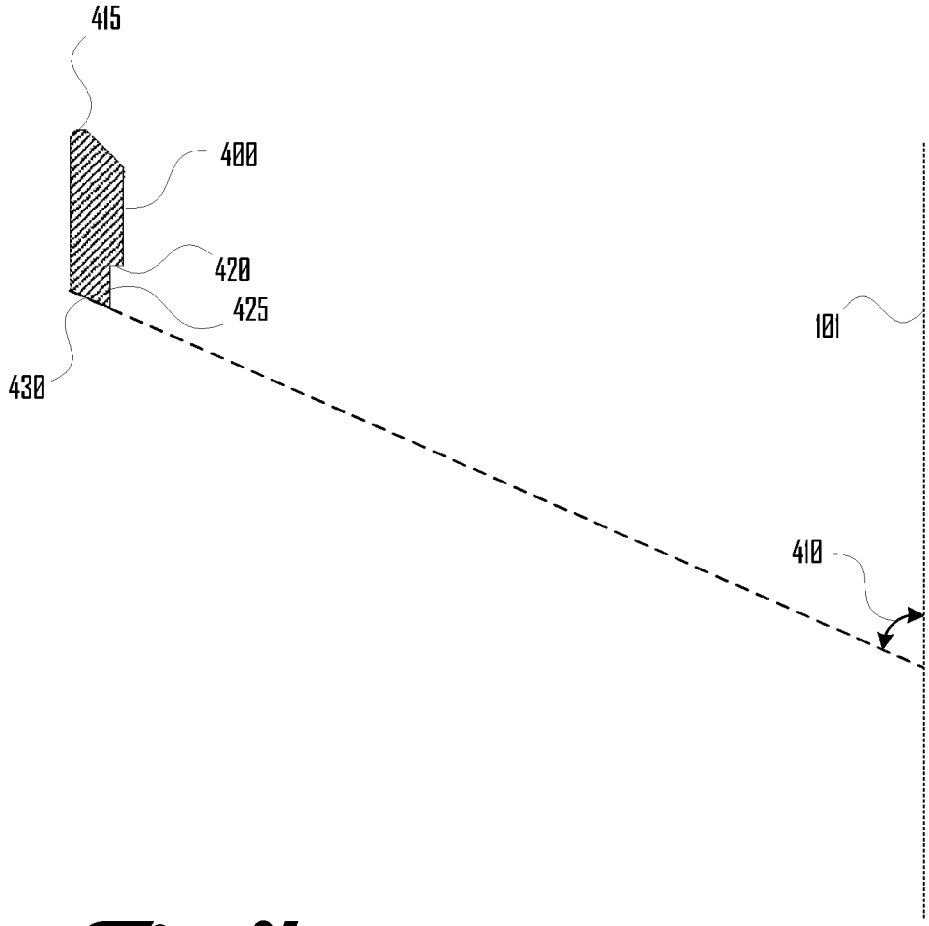

FIG. 4*a* illustrates circumferentially-fixed bearing ring 400 in accordance with one embodiment. FIG. 4*b* illustrates a cross-section of bearing ring 400, taken at the plane indicated by broken line 405, in accordance with one embodiment. Bearing ring 400 provides the annular drumhead-contact surface 415, which encircles upper mouth of drum tuning assembly 100, and which contacts a central portion of the drumhead 215 (as opposed to the periphery of the drumhead). Drumhead 215 is not shown in FIG. 4, but see FIGS. 2-3. Circumferentially-fixed bearing ring 400 also includes a flat (non-inclined) annular surface 420 and cylindrical pilot surface 425, whose functions are discussed further below.

In the illustrated embodiment, circumferentially-fixed bearing ring 400 also includes a circumferentially-fixed annular inclined plane surface 430, which is radially inclined with respect to central assembly axis 101 at angle 410.

Figure 5A:
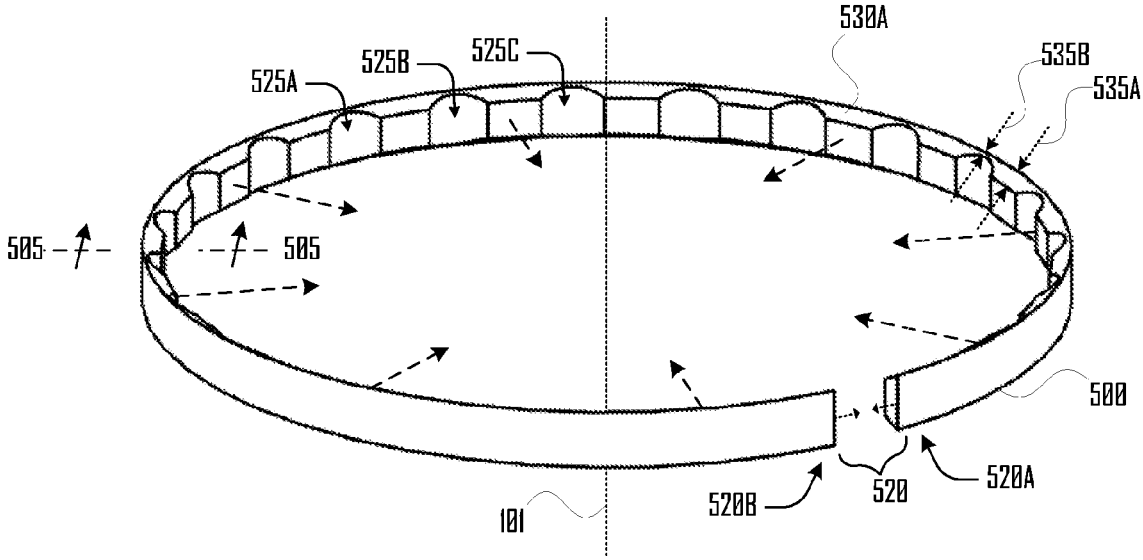
FIGS. 5*a-b* are perspective and cross-section views of a circumferentially-variable wedging ring in accordance with one embodiment.

FIG. 5*a* illustrates circumferentially-variable wedging ring 500 in accordance with one embodiment. In the illustrated embodiment, circumferentially-variable wedging ring 500 encircles central assembly axis 101 and has a discontinuity 520 or gap in its periphery that allows wedging ring 500 to deflect circumferentially (and radially) when an external force is applied (e.g., via adjustable circumferential-tensioning assembly 600, see FIG. 6, discussed below).

In other embodiments, a tensioning assembly (not shown) may be affixed to ends 520A-B of wedging ring 500. In such embodiments, a single tensioning screw (not shown) may be adjustably affixed to one of ends 520A-B, with a mating nut or other threaded receiver (not shown) being affixed to the other of ends 520A-B, such that the circumference (and therefore the radius and diameter) of wedging ring 500 can be varied by operating the tensioning screw (not shown).

In the illustrated embodiment, the radial thickness of circumferentially-variable wedging ring 500 may be locally reduced from a first radial thickness 535A to a reduced radial thickness 535B in multiple locations around its periphery, such as with "scallops" on the inner diameter (e.g. 525A-C and similar unlabeled scallops). In such embodiments, the local thickness-reductions reduce the flexural stiffness of circumferentially-variable wedging ring 500, thereby reducing the force required to circumferentially (and radially) deflect it. Such stiffness reduction may reduce the amount of force required on a tensioning assembly (not shown) to tighten the drumhead (not shown).

Figure 5B:
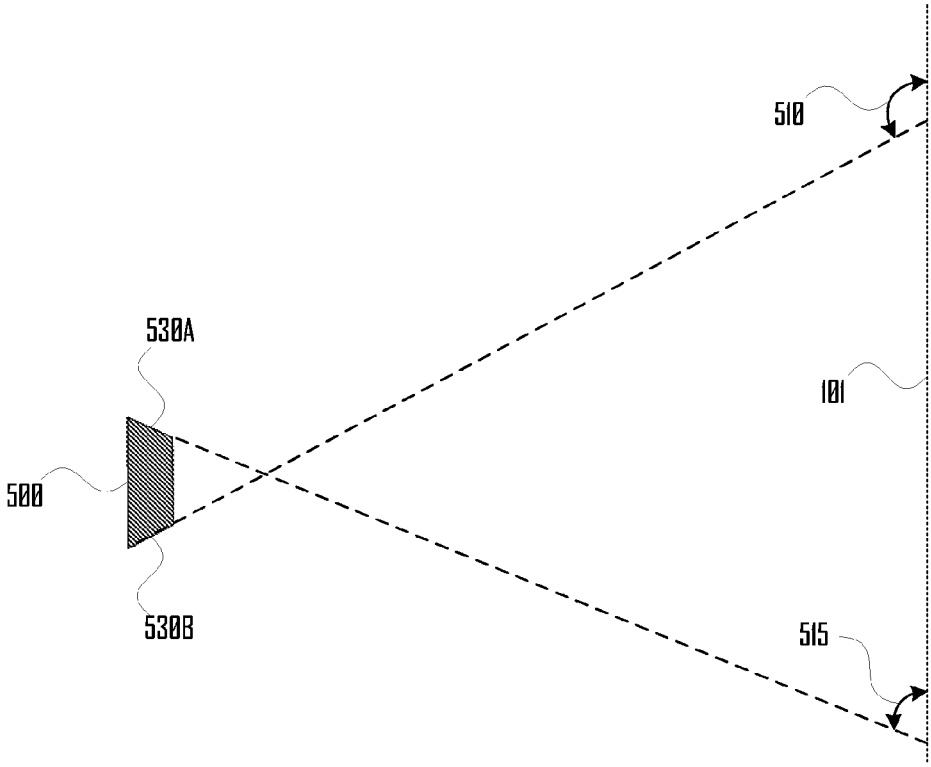

FIG. 5*b* illustrates the wedge-shaped cross-section of circumferentially-variable wedging ring 500, taken at the plane indicated by broken line 505, in accordance with one embodiment. In the illustrated embodiment, circumferentially-variable wedging ring 500 includes upper and lower circumferentially-variable annular inclined plane surfaces 530A-B, which are radially inclined with respect to central assembly axis 101 at angles 515 and 510, respectively. In the illustrated embodiment, upper circumferentially-variable annular inclined plane surfaces 530A is configured to contact and adjustably traverse circumferentially-fixed annular inclined plane surface 430 of bearing ring 400 (discussed above) as wedging ring 500 circumferentially (and radially) deflects. To that end, angle 515 is supplementary to angle 410.

For example, FIG. 3 shows upper circumferentially-variable annular inclined plane surface 530A of wedging ring 500 in partial contact with annular inclined plane surface 430 of bearing ring 400.

Figure 6:
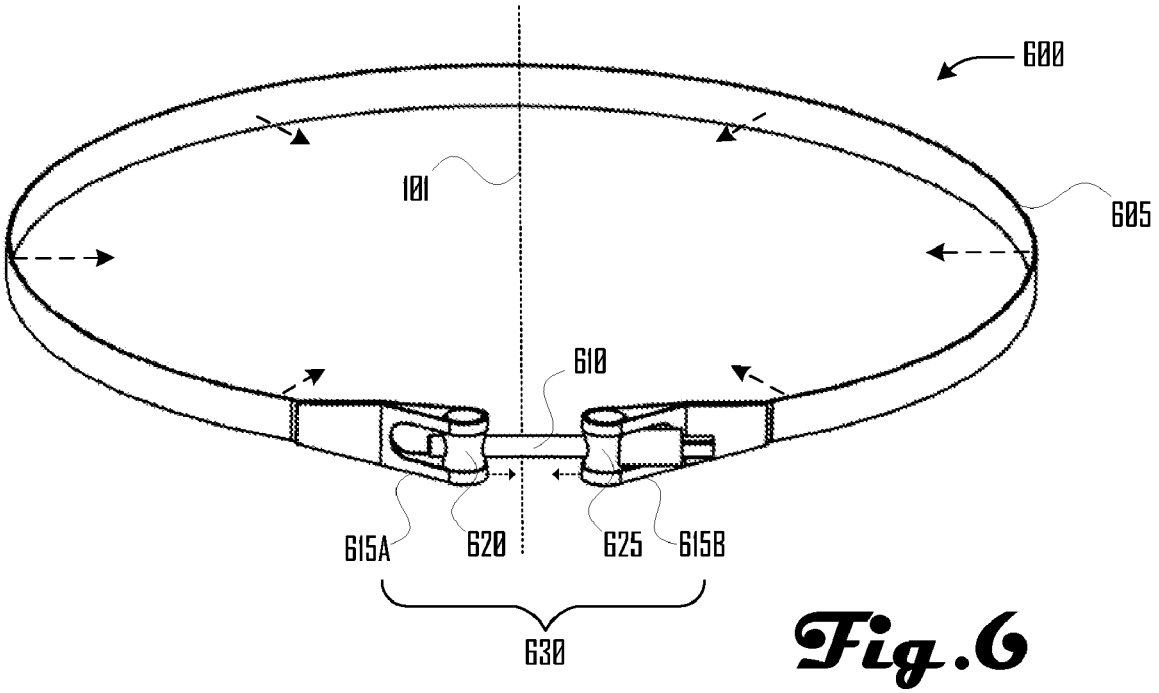
FIG. 6 illustrates a tensioning assembly, in accordance with one embodiment.

FIG. 6 illustrates an adjustable circumferential-tensioning assembly 600 such as may be positioned snugly around the outside periphery of circumferentially-variable wedging ring 500 (not shown in FIG. 6, but see FIGS. 1 and 3) to encircle central assembly axis 101, in accordance with one embodiment. In the illustrated embodiment, adjustable circumferential-tensioning assembly 600 includes tension strap 605, which is a flexible member or strap that can be flexed into a circular shape, but has sufficient strength and stiffness in its longitudinal direction (or hoop direction, when in a circular shape) to transmit a circumferential force in the strap into radial force in circumferentially-variable wedging ring 500 without excessive stretching.

On each end of tension strap 605 are barrel-retaining features 615A-B that contain a threaded barrel nut 620 on one end and a barrel washer 625 on the other end. With tension strap 605 deflected into a circular shape, a single tensioning screw 610 is inserted through the barrel washer 625 and threaded into the barrel nut 620. The barrel nut 620 and barrel washer 625 can freely rotate within barrel-retaining features 615A-B to ensure the tensioning screw 610 remains aligned with the threads in the barrel nut 620 as adjustable circumferential-tensioning assembly 600 is tightened. For convenience in handling, features (not shown) may be added to the circumferentially-variable wedging ring 500 (not shown) and/or tension strap 605 to retain the tension strap 605 on circumferentially-variable wedging ring 500, even while the apparatus is disassembled.

As torque is applied to tighten the tensioning screw 610, the tension strap 605 transmits the circumferential force developed by the tensioning screw 610 into a uniform, radially-inward force that "squeezes" the circumferentially-variable wedging ring 500 (not shown in FIG. 6, but see FIGS. 1 and 3) radially-inward, decreasing its diameter.

As can be seen in FIG. 3, when the diameter of wedging ring 500 decreases, circumferentially-variable annular inclined plane surface 530A of wedging ring 500 traverses annular inclined plane surface 430 of bearing ring 400, generating an axial force in bearing ring 400 directed away from support ring (or shell) 205. In turn, bearing ring 400 transmits this axial force directed away from support ring 205 into tension in drumhead 215. By varying the amount of external force applied, the tension, and therefore the musical pitch, of the drumhead is varied.

Figure 7A:
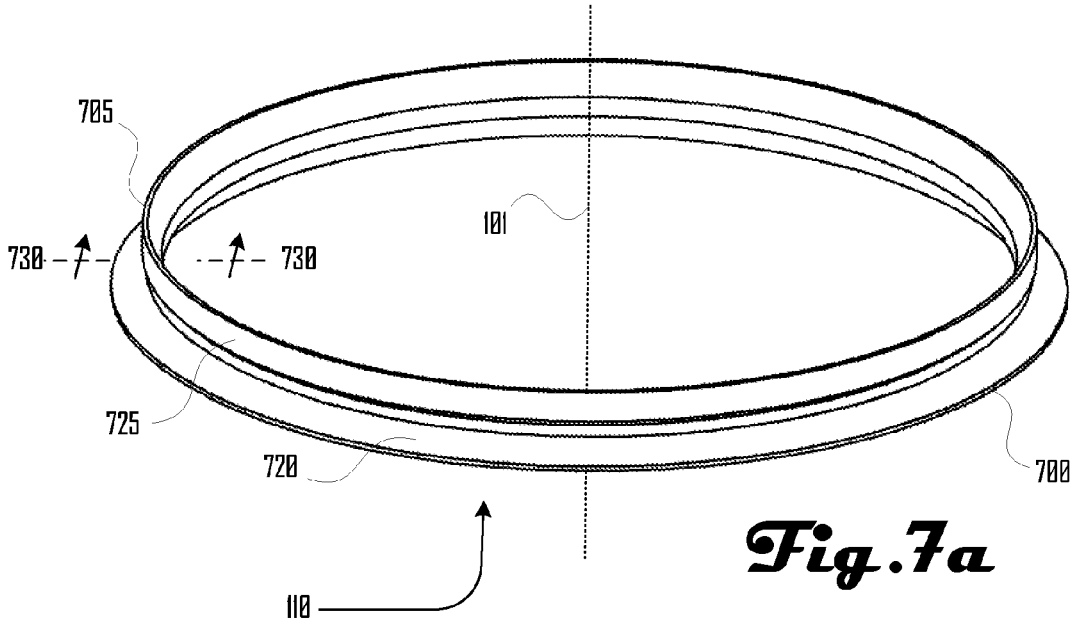
FIGS. 7*a-b* are perspective and cross-section views of a pilot ring in accordance with one embodiment.
Figure 7B:
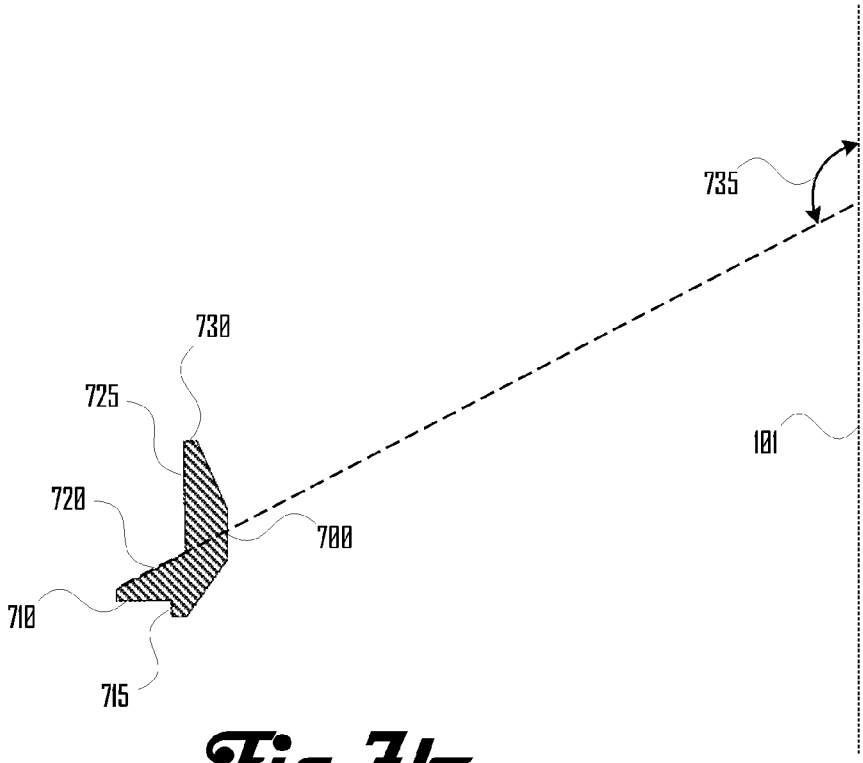

FIG. 7*a* illustrates pilot ring 700 encircling central assembly axis 101 and lower mouth 110 of drum tuning assembly 100 in accordance with one embodiment. FIG. 7*b* illustrates the cross-section of pilot ring 700, taken at the plane indicated by broken line 730, in accordance with one embodiment. In the illustrated embodiment, pilot ring 700 serves as a mounting interface of drum tuning assembly 100 to a fixed support ring 205 (not shown in FIG. 7). More specifically, lower surface 710 rests against the end of the fixed support ring 205 (not shown in FIGS. 7*a-b*, but see edge 305 in FIG. 3). In various embodiments, pilot ring 700 may be permanently or removably affixed to the fixed support ring 205. In other embodiments, pilot ring 700 may simply rest against an end of the fixed support ring 205, being held in position by compression force in the assembly due to drumhead tension.

In one embodiment, pilot ring 700 is positioned with respect to fixed support ring 205 by a small lip 715, which interfaces with the inner diameter of fixed support ring 205 (not shown in FIGS. 7*a-b*, but see inner surface 805 in FIGS. 8*a-c*, discussed below).

In the illustrated embodiment, pilot ring 700 also includes a circumferentially-fixed annular inclined plane surface 720, which is radially inclined with respect to central assembly axis 101 at angle 735 and is configured to contact lower circumferentially-variable annular inclined plane surface 530B of wedging ring 500 such that annular inclined plane surface 530B adjustably traverses circumferentially-fixed annular inclined plane surface 720 as wedging ring 500 circumferentially (and radially) deflects (not shown in FIGS. 7*a-b*, but this contact is visible in FIG. 3). To that end, angle 735 is supplementary to angle 515.

In the illustrated embodiment, cylindrical surface 725 of pilot ring 700 functions as a piloting diameter for cylindrical surface 425 of bearing ring 400 (not shown in FIGS. 7*a-b*, but see FIGS. 3-4 and 8), to facilitate maintaining concentricity of bearing ring 400 (and therefore drumhead 215) with respect to central assembly axis 101 throughout bearing ring 400's operational range of motion.

Similarly, in the illustrated embodiment, annular alignment surface 730 provides a resting surface for annular surface 420 of bearing ring 400 (see FIG. 4, discussed above) when bearing ring 400 is in a minimum-tension position (see, e.g., cross-section view 800A in FIG. 8*a*, discussed below), thereby encouraging bearing ring 400 (and by extension, a drumhead stretched across bearing ring 400) to be parallel to the end of a drum shell or other fixed support ring prior to tightening. To that end, annular alignment surface 730 and annular surface 420 may be radially inclined with respect to central assembly axis 101 at supplementary angles. In the illustrated embodiment, both annular alignment surface 730 and annular surface 420 are orthogonal to central assembly axis 101.

Figure 8A:
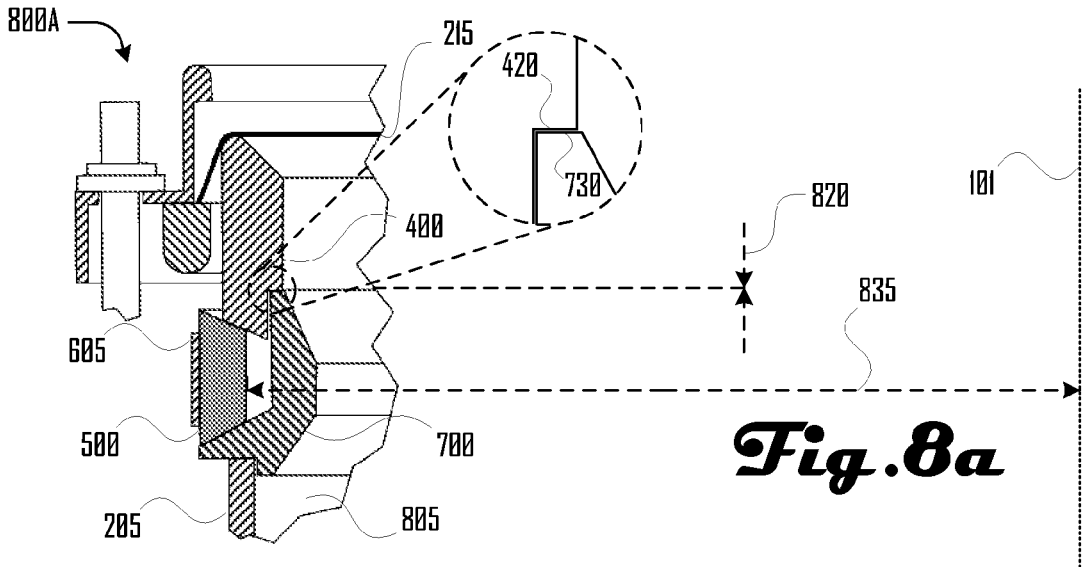
FIGS. 8*a-c* illustrate the kinematics of the drumhead assembly via cross-section views at three different head-tension positions, in accordance with one embodiment.
Figure 8B:
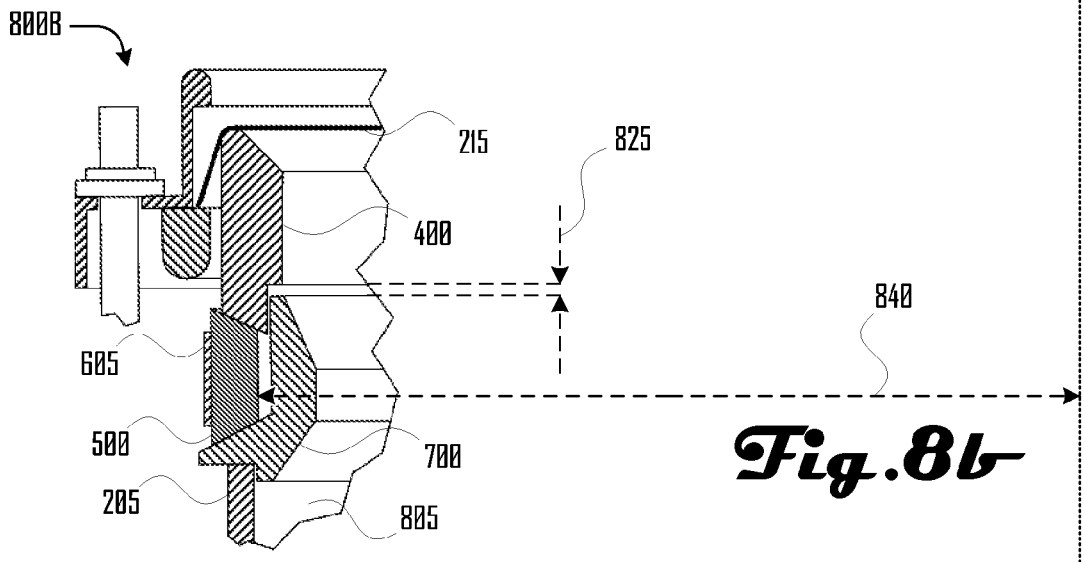
Figure 8C:
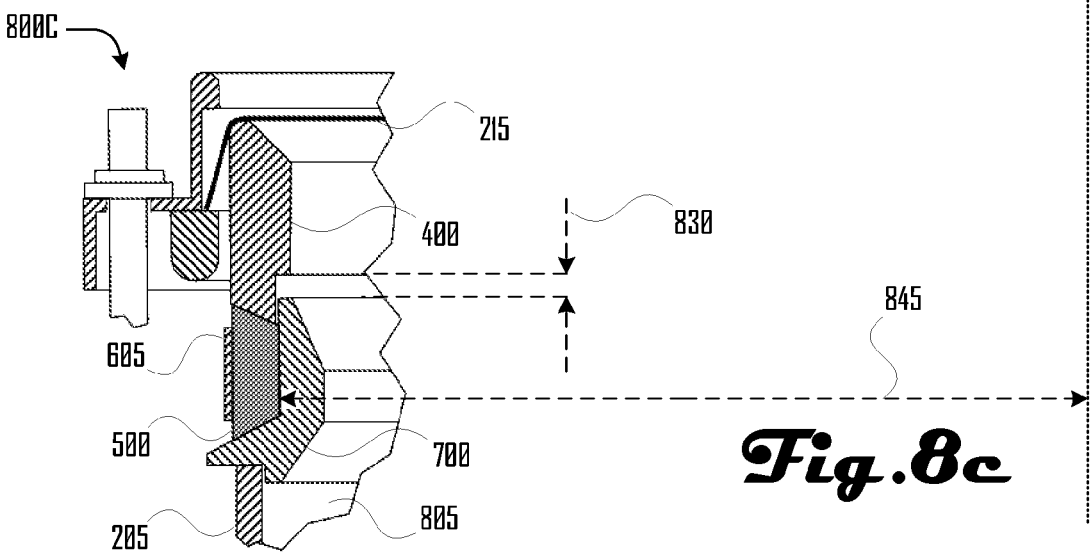

FIGS. 8*a-c* illustrate three cross-section views 800A-C (taken at the plane indicated by broken line 240 in FIG. 2) through drum tuning assembly 100 at three different drumhead-tension positions to illustrate the kinematics involved. As illustrated in cross-section view 800A, in the minimum-tension position, circumferentially-variable wedging ring 500 is at its maximum operational radius 835 (and thus its maximum operational circumference) and circumferentially-fixed bearing ring 400 is at its minimum travel distance 820, resting directly against pilot ring 700, with surface 730 of pilot ring 700 contacting surface 420 of bearing ring 400.

As illustrated in cross-section view 800B, in a medium-tension position, circumferentially-variable wedging ring 500 has deflected radially-inward to a medium radius 840 due to external circumferential force applied by the tension strap 605. Wedging ring 500 has axially translated bearing ring 400 away from fixed support ring 805 to a medium travel distance 825. Consequently, medium tension is applied to drumhead 215.

As illustrated in cross-section view 800C, in the maximum-tension position, circumferentially-variable wedging ring 500 has deflected radially-inward to its minimum operational radius 845, axially translating bearing ring 400 further away from fixed support ring 805 to bearing ring 400's maximum travel distance 830. Consequently, maximum tension is applied to drumhead 215. By varying the external force applied to circumferentially-variable wedging ring 500, such as by means of an adjustable circumferential-tensioning assembly 600 as previously described, a musical drum can be tuned to any desirable drumhead tension, and thus musical pitch, within the limits of the minimum and maximum tension positions.

Figure 9:
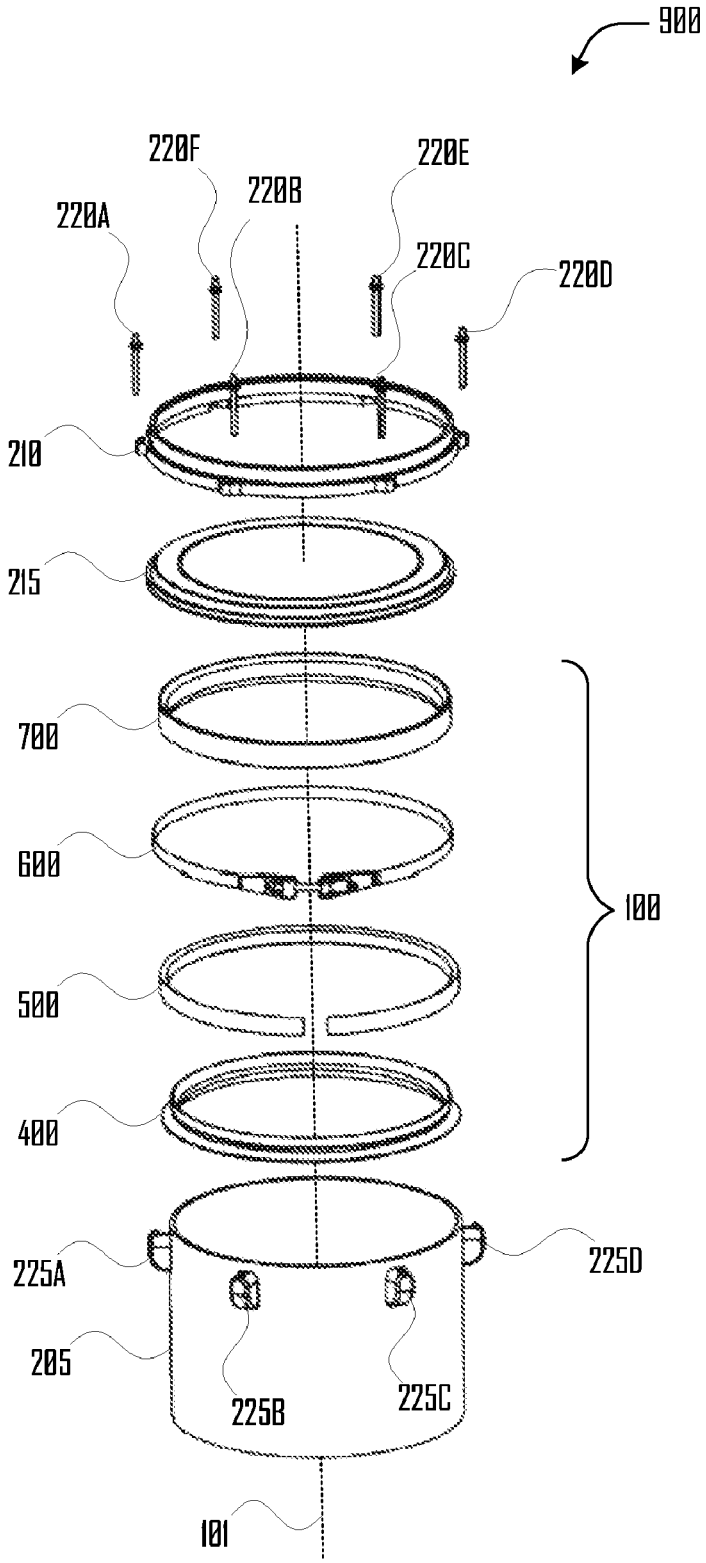
FIG. 9 is an exploded view of an acoustic drum incorporating the drumhead assembly, in accordance with one embodiment.

FIG. 9 is an exploded view 900 of musical drum 200, incorporating tension rods 220A-F, hoop 210, drumhead 215, tuning lugs 225A-F, fixed support ring 205, and drum tuning assembly 100, including circumferentially-fixed bearing ring 400, adjustable circumferential-tensioning assembly 600, circumferentially-variable wedging ring 500, and pilot ring 400.

In many embodiments, various annular inclined plane surfaces (e.g., surface 720 of pilot ring 700, surfaces 530A-B of circumferentially-variable wedging ring 500, and surface 430 of bearing ring 400) have sufficiently-low sliding friction to enable efficient, uniform transmission of force (and motion) from the circumferentially-variable wedging ring 500 into the bearing ring 400. In other embodiments, some or all of such annular inclined plane surfaces may incorporate rolling-element bearings (not shown), which may further reduce sliding friction.

FIGS. 10-11, 12*a-b*, and 13 are detail part drawings for one embodiment of drum tuning assembly 100 designed for use on 8-18 inch diameter drum shells. Other embodiments may differ from the prototype detail drawings according to dimensions, materials, configuration, shape, and other like details.

Figure 10:
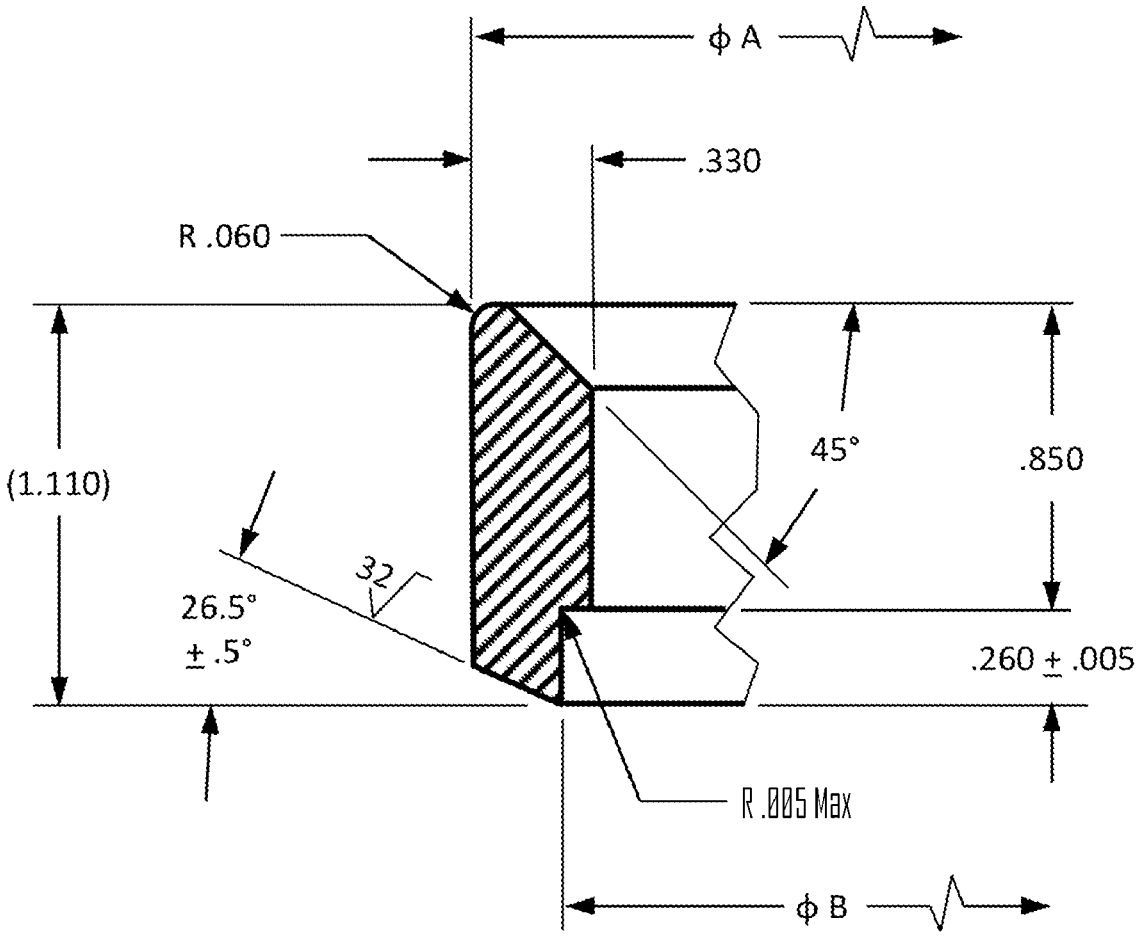
FIGS. 10-11, 12*a-b*, and 13 are detail part drawings for a drum tuning assembly, in accordance with one embodiment.

FIG. 10 is a detail part drawing of one embodiment of a bearing ring (e.g., circumferentially-fixed bearing ring 400). In one embodiment, such a bearing ring may be made of extruded acetal or other suitable material according to the indicated measurements. Dimensions øA and øB are determined according to the diameter of drum for which the bearing ring is designed to be used. For example, in one embodiment, dimensions øA and øB may be determined as set forth in Table 1.

TABLE 1

| Drum Diameter | øA | øB |
|---|---|---|
| 18 inch | 17.875 | 17.365 |
| 16 inch | 15.875 | 15.365 |
| 14 inch | 13.875 | 13.365 |
| 13 inch | 12.875 | 12.365 |
| 12 inch | 11.875 | 11.365 |
| 10 inch | 9.875 | 9.365 |
| 8 inch | 7.875 | 7.365 |

Figure 11:
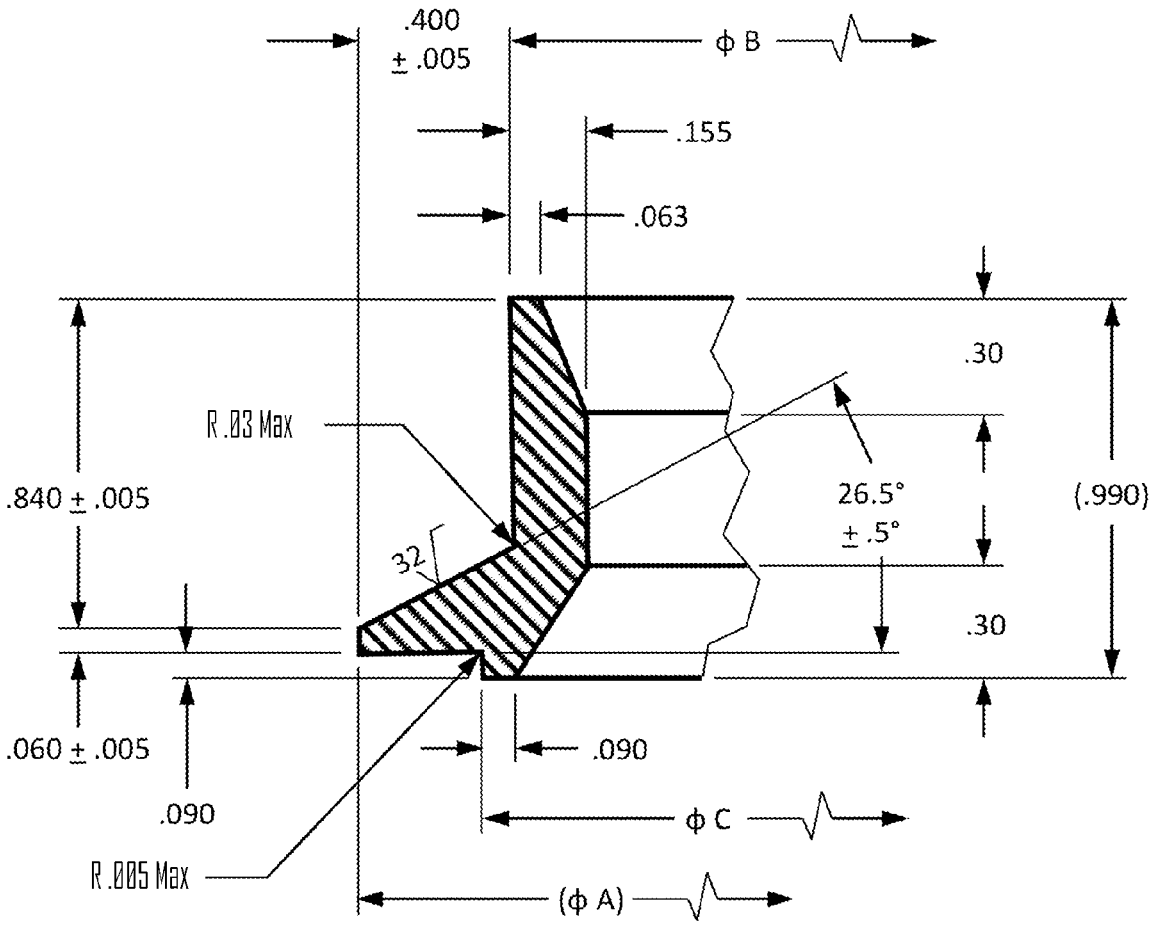

FIG. 11 is a detail part drawing of one embodiment of a pilot ring (e.g., pilot ring 700). In one embodiment, such a pilot ring may be made of extruded acetal or other suitable material according to the indicated measurements. Dimensions øA, øB, and øC are determined according to the diameter of drum for which the bearing ring is designed to be used. For example, in one embodiment, dimensions øA, øB, and øC may be determined as set forth in Table 2.

TABLE 2

| Drum Diameter | øA | øB | øC |
|---|---|---|---|
| 18 inch | 18.145 | 17.345 | 17.545 |
| 16 inch | 16.145 | 15.345 | 15.545 |
| 14 inch | 14.145 | 13.345 | 13.545 |
| 13 inch | 13.145 | 12.345 | 12.545 |
| 12 inch | 12.145 | 11.345 | 11.545 |
| 10 inch | 10.145 | 9.345 | 9.545 |
| 8 inch | 8.145 | 7.345 | 7.545 |

Figure 12A:
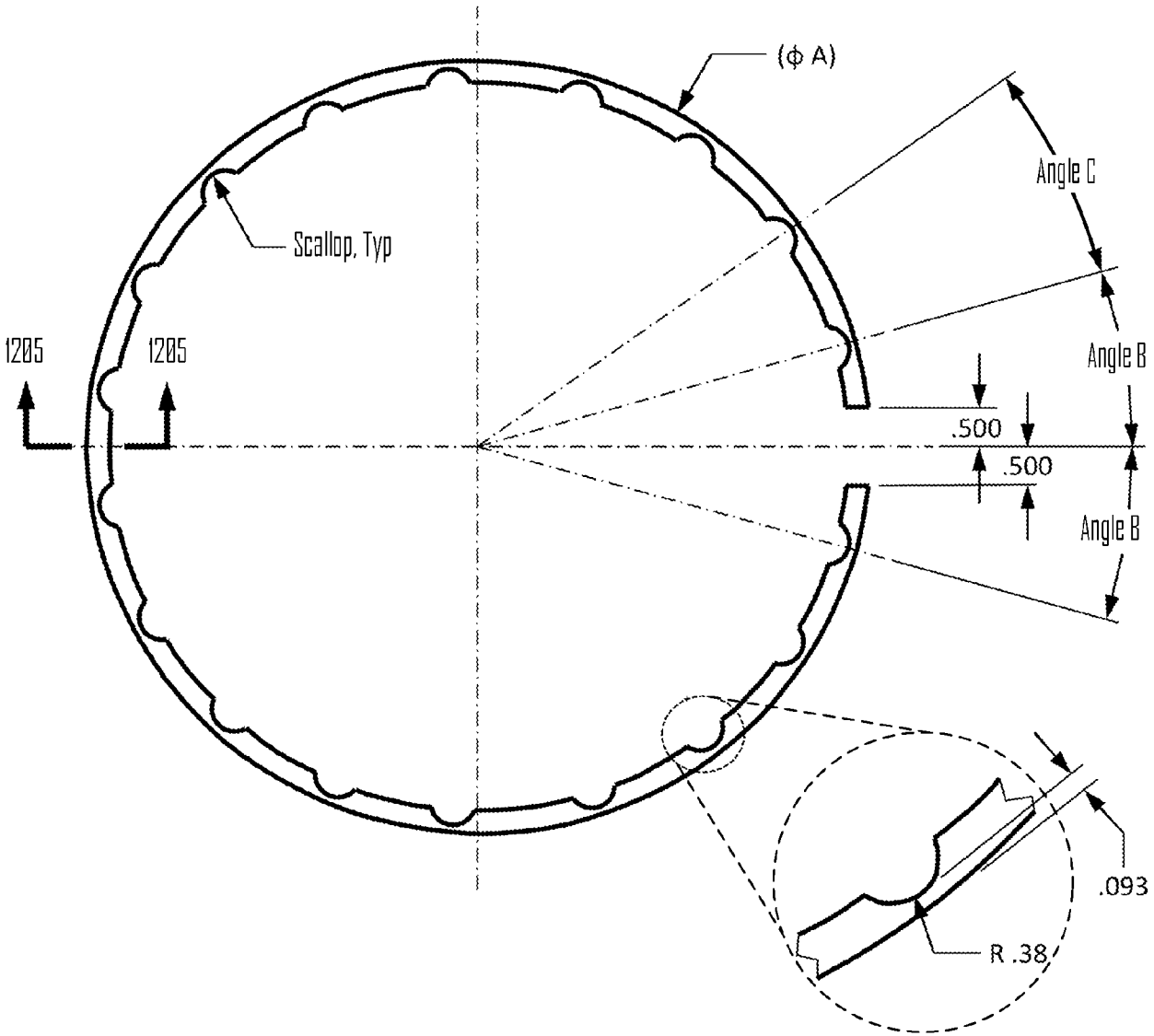
Figure 12B:
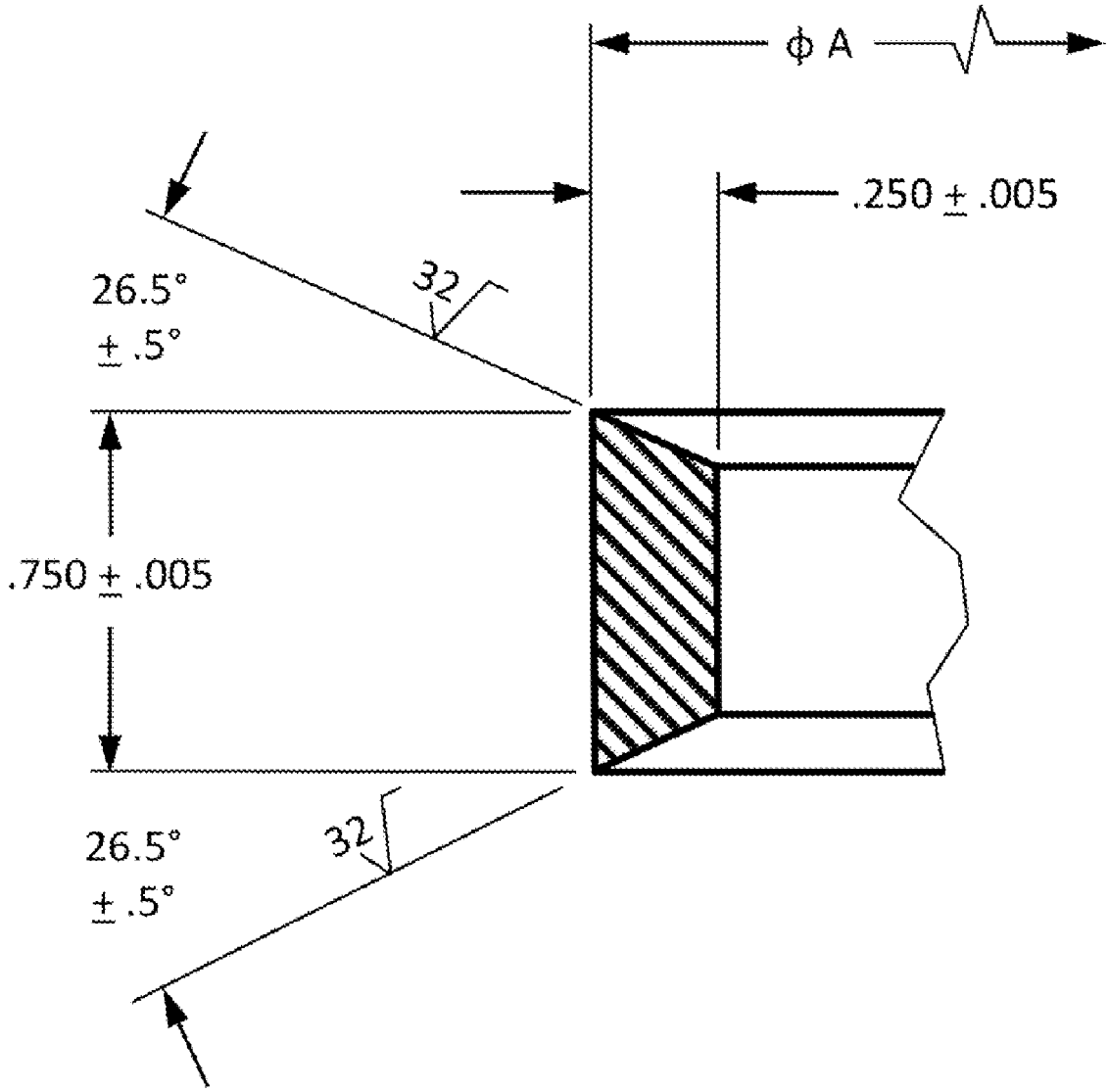

FIGS. 12*a-b* are detail part drawings of one embodiment of a circumferentially-variable wedging ring (e.g., wedging ring 500). FIG. 12*b* shows a cross-section of the circumferentially-variable wedging ring taken at the plane indicated by line 1205 in FIG. 12*a*. In one embodiment, such a wedging ring may be made of extruded acetal or other suitable material according to the indicated measurements. Dimension øA, angle B, and angle C (which applies at all locations not otherwise specified) are determined according to the diameter of drum for which the wedging ring is designed to be used. For example, in one embodiment, øA, angle B, and angle C may be determined as set forth in Table 3.

TABLE 3

| Drum Diameter | øA | Angle B (degrees) | Angle C (degrees) | # of scallops |
|---|---|---|---|---|
| 18 inch | 18.095 | 9.50 | 9.74 | 36 |
| 16 inch | 16.095 | 11.00 | 10.90 | 32 |
| 14 inch | 14.095 | 12.50 | 12.41 | 28 |
| 13 inch | 13.095 | 13.50 | 13.32 | 26 |
| 12 inch | 12.095 | 15.00 | 14.35 | 24 |
| 10 inch | 10.095 | 18.50 | 19.00 | 18 |
| 8 inch | 8.095 | 24.00 | 24.00 | 14 |

Figure 13:
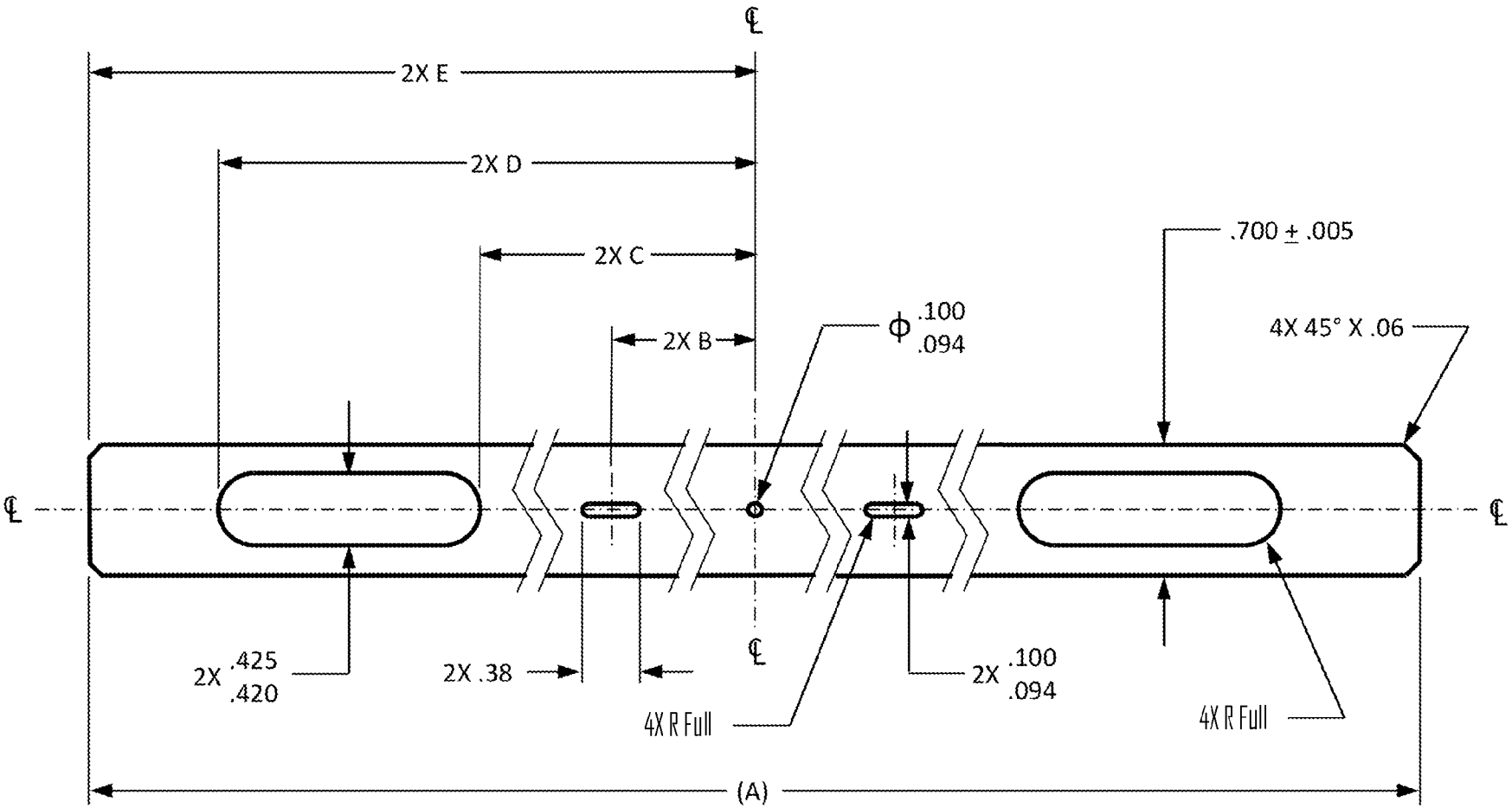

FIG. 13 is a detail part drawing of one embodiment of a tension strap (e.g., tension strap 600). In one embodiment, such a tension strap may be made of 300-series stainless steel shim stock, 0.015 inches thick, or other suitable material according to the indicated measurements. Dimensions A, B, C, D, and E are determined according to the diameter of drum for which the tension strap is designed to be used. For example, in one embodiment, dimensions A, B, C, D, and E may be determined as set forth in Table 4.

TABLE 4

| Drum Diameter | (A Ref) | B | C | D | E |
|---|---|---|---|---|---|
| 18 inch | 62.828 | 18.49 | 27.366 | 30.289 | 31.414 |
| 16 inch | 56.546 | 16.87 | 24.225 | 27.148 | 28.273 |
| 14 inch | 50.262 | 15.27 | 21.083 | 24.006 | 25.131 |
| 13 inch | 47.120 | 13.73 | 19.512 | 22.435 | 23.560 |
| 12 inch | 43.980 | 12.15 | 17.942 | 20.865 | 21.990 |
| 10 inch | 37.696 | 10.06 | 14.800 | 17.723 | 18.848 |
| 8 inch | 31.412 | 8.49 | 11.658 | 14.581 | 15.706 |

Figure 14:
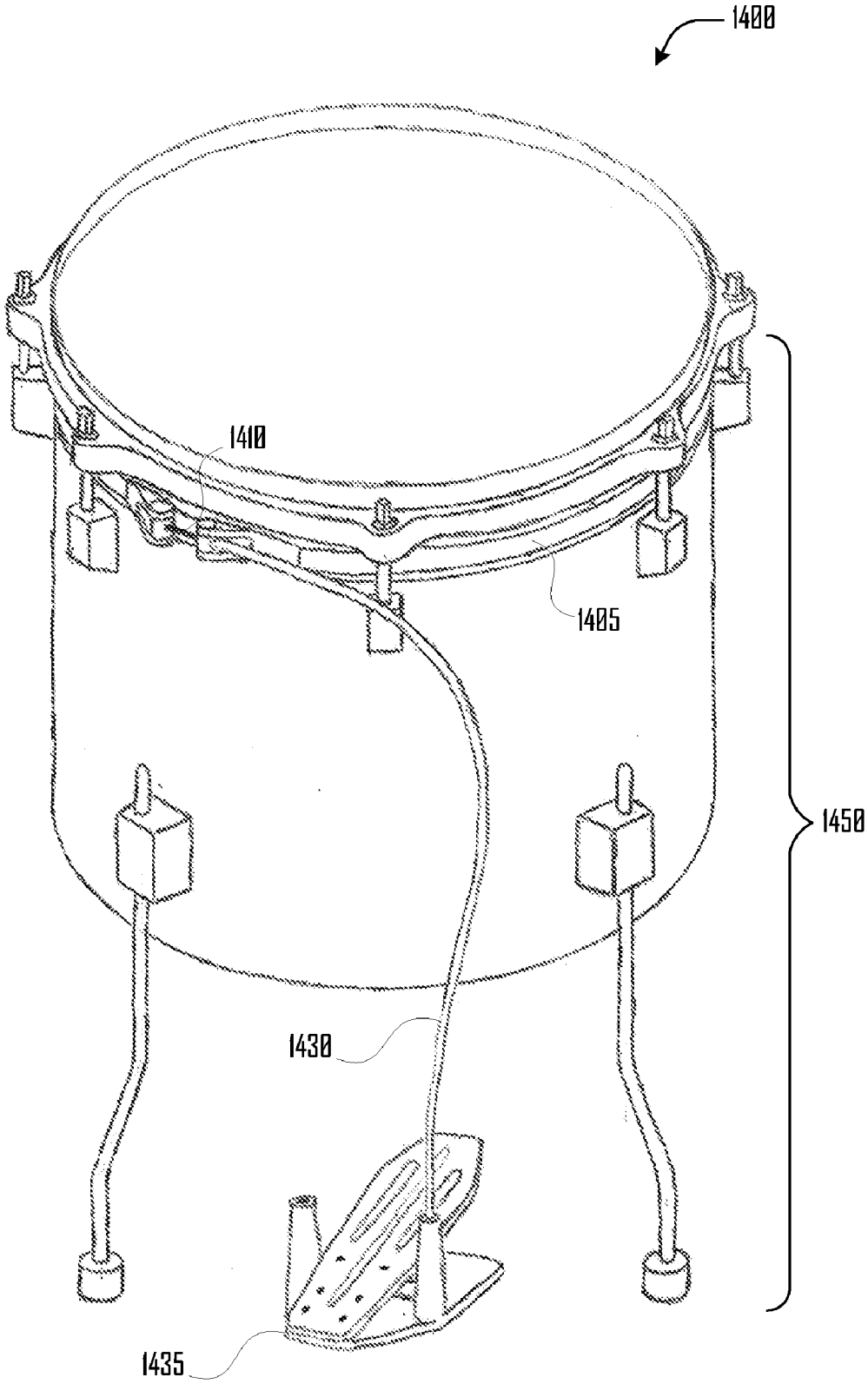
FIG. 14 illustrates a "dynamic" drum tuning assembly, in accordance with one alternate embodiment.

FIG. 14 illustrates drum 1400, including a drum tuning assembly 1450 having a "dynamic" actuation mechanism, in accordance with one alternate embodiment. Drum tuning assembly 1450 includes many identical components to drum tuning assembly 100, as discussed variously above, including identical bearing ring 400, circumferentially-variable wedging ring 500, and pilot ring 700, none of which are identified in FIG. 14. Drum tuning assembly 1450 is also used in connection with conventional components tension rods, rim, drumhead, tuning lugs, and shell or support frame that are identical to those discussed above.

However, drum tuning assembly 1450 differs from the embodiments discussed above in that drum tuning assembly 1450 includes a "dynamic" actuation mechanism for dynamically adjusting the tension in tension strap 1405 (thereby dynamically tuning drum 1400). Dynamic actuation mechanism includes cable 1410, sheath 1430, and foot pedal 1435. The sheath 1430 of cable 1410 is attached to one end of the tension strap 1405, and the end of cable 1410 itself is attached to the other end of the tension strap 1405. Cable 1410 routes through sheath 1430 to foot pedal 1435, which provides the mechanical advantage to dynamically adjust the tension of the drumhead. As foot pedal 1435 is depressed, cable 1410 tightens tension strap 1405 in the same manner that the tensioning screw 610 tightens tension strap 605 in the embodiments discussed above. In various embodiments, pedal 1435 may have different "feels," such as being spring-loaded to always return to the low-pitch (minimum tension) setting when foot pressure is removed. Alternately, in some embodiments, pedal 1435 may be configured to remain at a desired position when foot pressure is removed.

Although specific embodiments have been illustrated and described herein, it will be appreciated by those of ordinary skill in the art that alternate and/or equivalent implementations may be substituted for the specific embodiments shown and described without departing from the scope of the present disclosure.

For example, in one alternate embodiment, wedging ring 500 may be equipped with a plurality of small pins (e.g., three or more steel pins) protruding radially-outward from its external periphery, their angular spacing being approximately equal. Such pins may mate with corresponding holes and/or slots in the tension strap 605 for the purpose of axially- and circumferentially-positioning the tension strap 605 on the wedging ring 500.

For another example, although the embodiments discussed above include two pairs of annular inclined-plane surfaces (specifically, wedging ring 500 has upper and lower annular inclined-plane surfaces that traverse supplementary surfaces of bearing ring 400 and pilot ring 700, respectively), other embodiments need only include a single pair of annular inclined-plane surfaces: one circumferentially-fixed annular inclined-plane surface of a circumferentially-fixed ring, and one supplementary circumferentially-variable inclined-plane surface of a circumferentially-variable ring. The circumferentially-fixed and circumferentially-variable rings must be positioned such that the circumferentially-variable annular inclined-plane surface traverses the circumferentially-fixed annular inclined-plane surface, generating axial displacement, as the circumferentially-variable ring deflects. Otherwise, the circumferentially-fixed and circumferentially-variable rings and annular inclined-plane surfaces may be arranged in many different configurations.

For yet another example, although the descriptions above describe drumheads that are peripherally restrained by a conventional hoop that is adjustably fixed in place by conventional tension rods threaded into conventional tuning lugs, other embodiments may employ several retaining clips, affixed around the drum shell near one end, that may fix the hoop (and therefore the periphery of the drumhead) in place with respect to the drum shell or rigid support ring. Compared to conventional tension rods threaded into conventional tuning lugs, such retaining clips may make it more difficult to achieve uniform peripheral tension in the drumhead. On the other hand, compared to conventional tension rods threaded into conventional tuning lugs, such retaining clips may offer a "quick-release" capability that may make it easier to remove and/or replace the drumhead. In certain circumstances, the "quick-release" capability may make such retaining-clip hoop-fixing mechanisms desirable, as drum tuning assembly 100 would still afford the ability to tune the drum, notwithstanding the lack of tuning lugs and tension rods.

This application is intended to cover any such adaptations or variations of the embodiments discussed herein.

The invention claimed is:

1. A drumhead assembly comprising:

a fixed support ring encircling a central assembly axis;

a tuning assembly encircling said central assembly axis, said tuning assembly having a lower mouth, fixed in position adjacent to said fixed support ring, and an axially adjustable upper mouth, said tuning assembly comprising:

a circumferentially-fixed ring having a circumferentially-fixed annular inclined-plane surface, radially inclined at a first angle with respect to said central assembly axis;

a circumferentially-variable ring having a circumferential annular inclined-plane surface, radially inclined at a second angle, supplementary to said first angle with respect to said central assembly axis, said circumferentially-variable ring being positioned such that at least a portion of said circumferential annular inclined-plane surface contacts at least a portion of said circumferentially-fixed annular inclined-plane surface;

an adjustable circumferential-tensioning assembly configured to generate adjustable circumferential deflection of said circumferentially-variable ring, thereby causing said circumferential annular inclined-plane surface to traverse said circumferentially-fixed annular inclined-plane surface, generating an adjustable axial displacement force directed away from said fixed support ring; and an annular drumhead-contact surface encircling said upper mouth and coupled with said circumferentially-variable ring such that said adjustable axial displacement force causes axial displacement of said annular drumhead-contact surface between a minimum distance and a maximum distance from said fixed support ring; and a drumhead stretched across said upper mouth and said annular drumhead-contact surface, said drumhead having a restrained periphery positioned outside said tuning assembly and restrained with respect to said fixed support ring such that when said annular drumhead-contact surface is axially displaced to said minimum distance or said maximum distance, said annular drumhead-contact surface urges a central portion of said drumhead away from said fixed support ring under low tension or high tension, respectively.

2. The drumhead assembly of claim 1, wherein said tuning assembly further comprises a pilot ring encircling said lower mouth and configured to guide said axial displacement of said annular drumhead-contact surface and/or said circumferential deflection of said circumferentially-variable ring.

3. The drumhead assembly of claim 2, wherein said pilot ring comprises a circumferentially-fixed annular inclined-plane piloting surface, radially inclined at a third angle with respect to said central assembly axis; and wherein said circumferentially-variable ring further comprises a second circumferential annular inclined-plane surface that traverses said circumferentially-fixed annular inclined-plane piloting surface, said second circumferential annular inclined-plane surface being radially inclined at a fourth angle, supplementary to said third angle with respect to said central assembly axis.

4. The drumhead assembly of claim 2, wherein said pilot ring further comprises a cylindrical pilot surface, axially aligned with said central assembly axis; and wherein said circumferentially-fixed ring further comprises an inner cylindrical surface configured to slide axially along said cylindrical pilot surface as said circumferentially-variable ring deflects circumferentially.

5. The drumhead assembly of claim 2, wherein said annular drumhead-contact surface forms an upper surface, opposite said circumferentially-fixed annular inclined-plane surface, of said circumferentially-fixed ring.

6. The drumhead assembly of claim 5, wherein said pilot ring further comprises an upper annular alignment surface, orthogonal to said central assembly axis; and wherein said circumferentially-fixed ring further comprises a lower annular alignment surface, parallel to said upper annular alignment surface and said annular drumhead-contact surface, said lower annular alignment surface configured to rest on said upper annular alignment surface when said annular drumhead-contact surface is axially displaced to said minimum distance.

7. The drumhead assembly of claim 1, wherein said circumferentially-variable ring further comprises a peripheral discontinuity enabling said circumferentially-variable ring to deflect circumferentially.

8. The drumhead assembly of claim 7, wherein said circumferential-tensioning assembly comprises a single tensioning screw and a mating threaded receiver collectively configured to variably circumferentially-deflect said circumferentially-variable ring, thereby adjustably tuning said drumhead via an adjustment to said single tensioning screw.

9. The drumhead assembly of claim 8, wherein said circumferential-tensioning assembly further comprises a circumferentially-variable tension strap snugly encircling said circumferentially-variable ring, wherein said single tensioning screw is adjustably affixed to a first end of said tension strap, and wherein said mating threaded receiver is affixed to a second end of said tension strap.

10. The drumhead assembly of claim 8, wherein said peripheral discontinuity abuts a first end and a second end of said circumferentially-variable ring, said single tensioning screw being adjustably affixed to said first end of said circumferentially-variable ring, said mating threaded receiver being affixed to said second end of said circumferentially-variable ring.

11. The drumhead assembly of claim 7, wherein said circumferentially-variable ring further comprises a plurality of radial-thickness reductions spaced about a cylindrical surface of said circumferentially-variable ring.

12. The drumhead assembly of claim 1, wherein said fixed support ring comprises a cylindrical drum shell having a first end and a second end, said first end mating with said tuning assembly.

13. The drumhead assembly of claim 12, further comprising a retaining hoop, slightly smaller in diameter than said periphery of said drumhead, restraining said periphery of said drumhead, axially urging said periphery of said drumhead towards said second end of said drum shell.

14. The drumhead assembly of claim 13, further comprising a plurality of tuning lugs affixed around said drum shell near said first end, said plurality of tuning lugs adjustably restraining said retaining hoop with respect to said drum shell.

15. The drumhead assembly of claim 13, further comprising a plurality of retaining clips affixed around said drum shell near said first end, said plurality of retaining clips restraining said retaining hoop with respect to said drum shell.

16. A drum comprising:

a drum shell;

a drumhead stretched across an open end of said drum shell, said drumhead having a periphery positioned outside said drum shell, said periphery being restrained with respect to said drum shell;

a drum tuning assembly encircled a central assembly axis and positioned between said drum shell and said drumhead, said drum tuning assembly comprising:

bearing ring means for variably urging said drumhead away from said drum shell when said bearing ring means are axially displaced, said bearing ring means comprising a circumferentially-fixed ring having a circumferentially-fixed annular inclined-plane surface, radially inclined at a first angle with respect to said central assembly axis;

pilot ring means for guidedly and axially-adjustably coupling said bearing ring means with said drum shell;

wedging ring means for axially displacing said bearing ring means when said wedging ring means are circumferentially deflected, said wedging ring means comprising a circumferentially-variable ring having a circumferential annular inclined-plane surface, radially inclined at a second angle, supplementary to said first angle with respect to said central assembly axis, and contacting at least a portion of said circumferentially-fixed annular inclined-place surface; and adjustable circumferential-tensioning assembly means for adjustably circumferentially-deflecting said wedging ring means, thereby causing said circumferential annular inclined-plane surface to traverse said circumferentially-fixed annular inclined-plane surface, axially displacing said bearing ring means.

17. The drum of claim 16, wherein said tensioning assembly means comprises dynamic actuation means for circumferentially-deflecting said wedging ring means in a dynamically adjustable manner.

* * * * *